US007540434B2

(12) United States Patent
Göhring et al.

(10) Patent No.: US 7,540,434 B2
(45) Date of Patent: Jun. 2, 2009

(54) SPRAY GUN

(75) Inventors: Alfred Göhring, Salem (DE); Guido Zimmermann, Friedrichshafen-Kluftern (DE); Elmar Krayer, Langenargen (DE)

(73) Assignee: J. Wagner GmbH

( * ) Notice: Subject to any disclaimer, the term of this patent is extended or adjusted under 35 U.S.C. 154(b) by 0 days.

(21) Appl. No.: 11/879,451

(22) Filed: Jul. 17, 2007

(65) Prior Publication Data

US 2008/0029619 A1 Feb. 7, 2008

(30) Foreign Application Priority Data

Jul. 22, 2006 (EP) ..... 06015298

(51) Int. Cl.
*B05B 1/28* (2006.01)
*B05B 1/00* (2006.01)

(52) U.S. Cl. ..... 239/297; 239/290; 239/301; 239/296; 239/600

(58) Field of Classification Search ..... 239/296, 239/297, 407, 416.5, 417.3, 417.5, 419.5, 239/420, 423, 424, 290, 292, 300, 301, 394, 239/397, 600; 411/427
See application file for complete search history.

(56) References Cited

U.S. PATENT DOCUMENTS 4,712,739 A 12/1987 Bihn
5,322,221 A * 6/1994 Anderson ..... 239/291
5,409,162 A * 4/1995 Sickles ..... 239/3
6,036,109 A * 3/2000 DeYoung ..... 239/301
6,068,203 A * 5/2000 DeYoung et al. ..... 239/297
6,612,506 B1 * 9/2003 Huang ..... 239/291
6,877,681 B2 * 4/2005 Hartle et al. ..... 239/691
2002/0148910 A1 * 10/2002 Reetz et al. ..... 239/296
2003/0052190 A1 3/2003 Ulrich et al.
2005/0145718 A1 7/2005 Blette et al.

FOREIGN PATENT DOCUMENTS

GB 2 247 193 2/1992

* cited by examiner

*Primary Examiner*—Len Tran
*Assistant Examiner*—James S Hogan
(74) *Attorney, Agent, or Firm*—Pandiscio & Pandiscio

(57) ABSTRACT

In a spray gun (1) for spraying paint with a gun housing (2) provided with a handle (3) with a union nut (10) screwed onto it that holds an air cap (11) provided with offset outlet openings (14, 15) for compressed air, the union nut (10) is positively connected to the air cap (11) in a circumferential direction. This embodiment makes it possible for the spray jet to be set in a brief time and without difficulties without having to put up with getting dirty. It is merely necessary to turn the union nut (10) accordingly in order to control the air supply to the outlet openings (14, 15) of the air cap (11) and therefore to influence the formation of the spray jet.

8 Claims, 7 Drawing Sheets

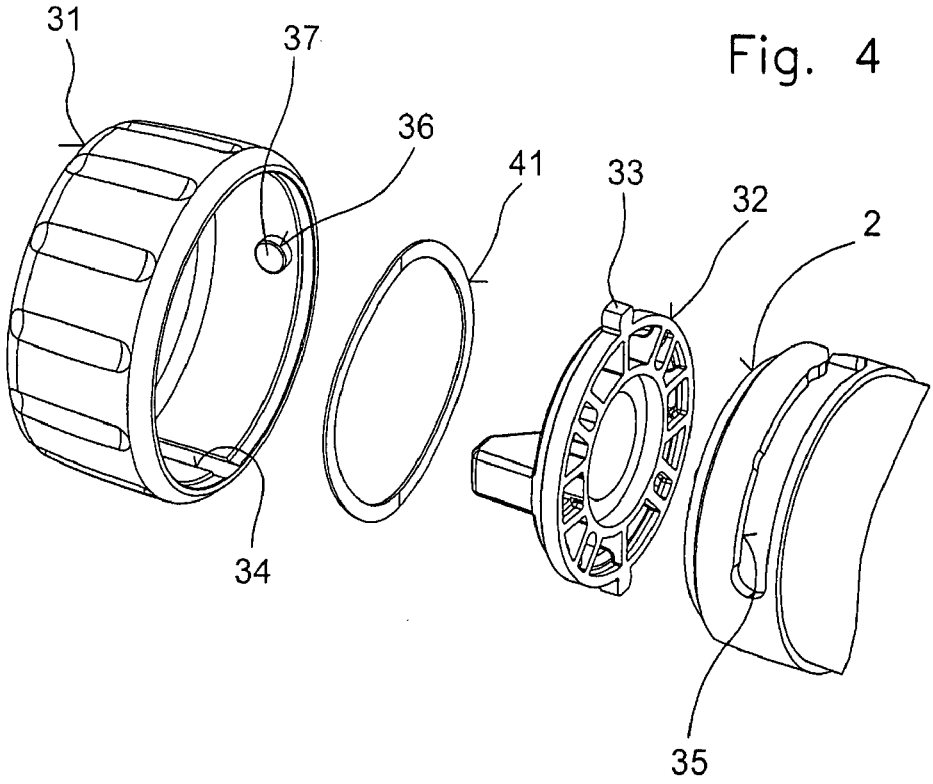
Fig. 4
Fig. 5
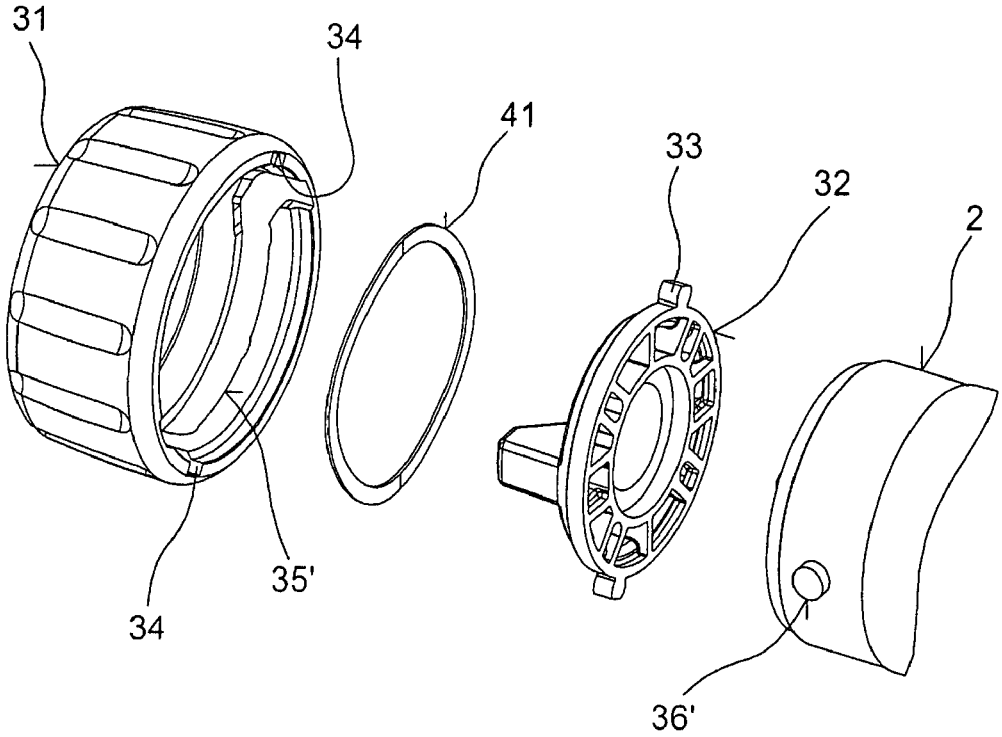

SPRAY GUN

BACKGROUND OF THE INVENTION

1. Field of the Invention

The present invention relates to a spray gun for spraying paints and similar viscous media that can be propelled pneumatically or electrically, comprising a gun housing for accommodating the propulsion mechanism, components of the spray gun that effect mixture and/or metering, a handle projecting from the gun housing, and a reservoir tank removably attached to the gun housing for holding the medium to be processed, as well as a union nut placed on the gun housing or an intermediate piece connected to the gun housing or an extension pipe, and an air cap surrounded by the union nut provided with mutually offset outlet openings for compressed air by means of which various spray jets can be formed and with an atomiser nozzle assigned to it that is held in an oriented position and can be opened by means of a nozzle needle.

2. Description of the Prior Art

Spray guns of this type have been offered for sale for many years by J. Wagner GmbH, Markdorf under the name W 850 E and have proven their effectiveness in practice. By turning the air cap through 90° in this case, it is possible to set three jet shapes for performing different jobs, namely a horizontally oriented flat jet, a round jet and a vertically oriented flat jet.

In order to set one of these spray shapes with this spray gun of the prior art, it is necessary to unscrew the union nut and turn the air cap to the corresponding position by hand with the union nut loosened. Then the union nut needs to be tightened again. However, the air cap has to be held in place when doing this in order to prevent it turning inadvertently. Also, the air cap can only be aligned precisely by visual contact, particularly when setting a round jet in order to cover the air supply to the outlet openings. Quite apart from the significant amount of time required in order to make these adjustments and settings, it is also necessary for the operator who is using the spray gun to use both hands in order to perform this task. Since it is necessary to use one hand to grip the air cap that has paint residue on it, the unavoidable consequence of changing the spray shape is that the operator will get his or her hands dirty. In many cases, therefore, the operator prefers not to change the spray shape in order to avoid getting paint on his or her hands.

The purpose of the present invention is therefore to create a spray gun of the aforementioned type that enables the shape of the spray jet to be changed within a short time without the need to grip the air cap and therefore without the need to put up with getting dirty hands. Rather, it should be possible to change the spray shape merely by turning the union nut or an equivalent holding element. The constructional complexity required in order to achieve this should be kept at a low level whilst nevertheless always allowing a reliable setting to be achieved quickly and in a straightforward procedure.

SUMMARY OF THE INVENTION

In accordance with the present invention, this is achieved in a spray gun of the aforementioned type in that the union nut or a holding element equivalent to it is positively connected with the air cap in the circumferential direction.

In this case, the air cap can be inserted into the union nut or the holding element and firmly connected to it, for example by welding. However, it is also possible for the air cap and the union nut or holding element to be manufactured from one piece and configured as an injection-moulded component.

According to a different embodiment, however, it is also possible for the air cap to be positively connected to the union nut or holding element by one or more radial cams, preferably projecting from the outer jacket surface of the air cap and distributed evenly around its circumference, with the cams engaging in slots worked into the union nut or holding element, with the further possibility of the air cap to be inserted into a ring and firmly connected to the ring, with cams projecting radially from the ring engaging in slots in the union nut or the holding element.

In accordance with a preferred embodiment, it should be possible to lock the holding element in the angular positions corresponding to the spray jets to be formed in an oriented position in relation to the component carrying it, for example the gun housing.

This can be accomplished in that the component carrying the holding element, for example the gun housing, that is used for setting and holding the air cap in an oriented position, or the holding element is provided with one or more, and preferably two, diametrically opposed control cams that are open at one end and run in the circumferential direction and the holding element or the component carrying the holding element is provided with guide elements protruding inwards or outwards that engage in the control cams.

In this case, the guide elements can be configured as guide pins and the control cams in which they engage can be provided with axially offset recesses for accommodating the guide pins in the operating positions corresponding to the air cap, whilst it is also possible for the guide elements to be configured as radially sprung tabs and for the control cams holding them to be provided with detent cams distributed in the circumferential direction, preferably with even spacing, between which the tabs can be locked in the operating positions corresponding to the air cap.

Also, the air cap on its end facing the housing of the spray gun should be sealed against the component supporting it by means of a labyrinth seal, this ensures that the atomiser nozzle is in a precisely coaxial alignment in relation to the air cap.

Also, the air cap on its end facing the housing of the spray gun should be sealed against the component supporting it by means of a labyrinth seal, furthermore this ensures that the atomiser nozzle is in a precisely coaxial alignment in relation to the air cap.

If a spray gun is configured in accordance with the present invention, it is possible for the spray jet to be set within a short time and without difficulties and without the need to put up with getting dirty hands. The air cap is positively connected to the union nut or holding element in the circumferential direction and this means it is merely necessary to turn the union nut or holding element accordingly in order to control the air supply from the atomiser nozzle installed in its fixed position to the outlet openings of the air cap and therefore to influence the formation of the spray jet. Also, different detent positions are assigned to the holding element, therefore it is assured that different formations of the spray jet are provided merely by turning, for example through 45°.

The constructional complexity by means of which this is made possible is extremely low because only a positive connection between the air cap and the union nut or holding element is provided in the turning direction and this connection can be configured in different ways. Also, the adjustment is very easy and can be performed with only one hand, which means that adaptations of the spray jet in accordance with the work to be performed can be undertaken with practically no interruption in the job.

BRIEF DESCRIPTION OF THE DRAWINGS

The drawings shows some sample embodiments of the spray gun configured in accordance with the present invention which are explained in detail below. In the drawings, FIGS. 3 to 5 show sample embodiments of the positive connection between the air cap and the union nut in defined detent positions as exploded views.

DESCRIPTION OF THE PREFERRED EMBODIMENTS

Figure 1:
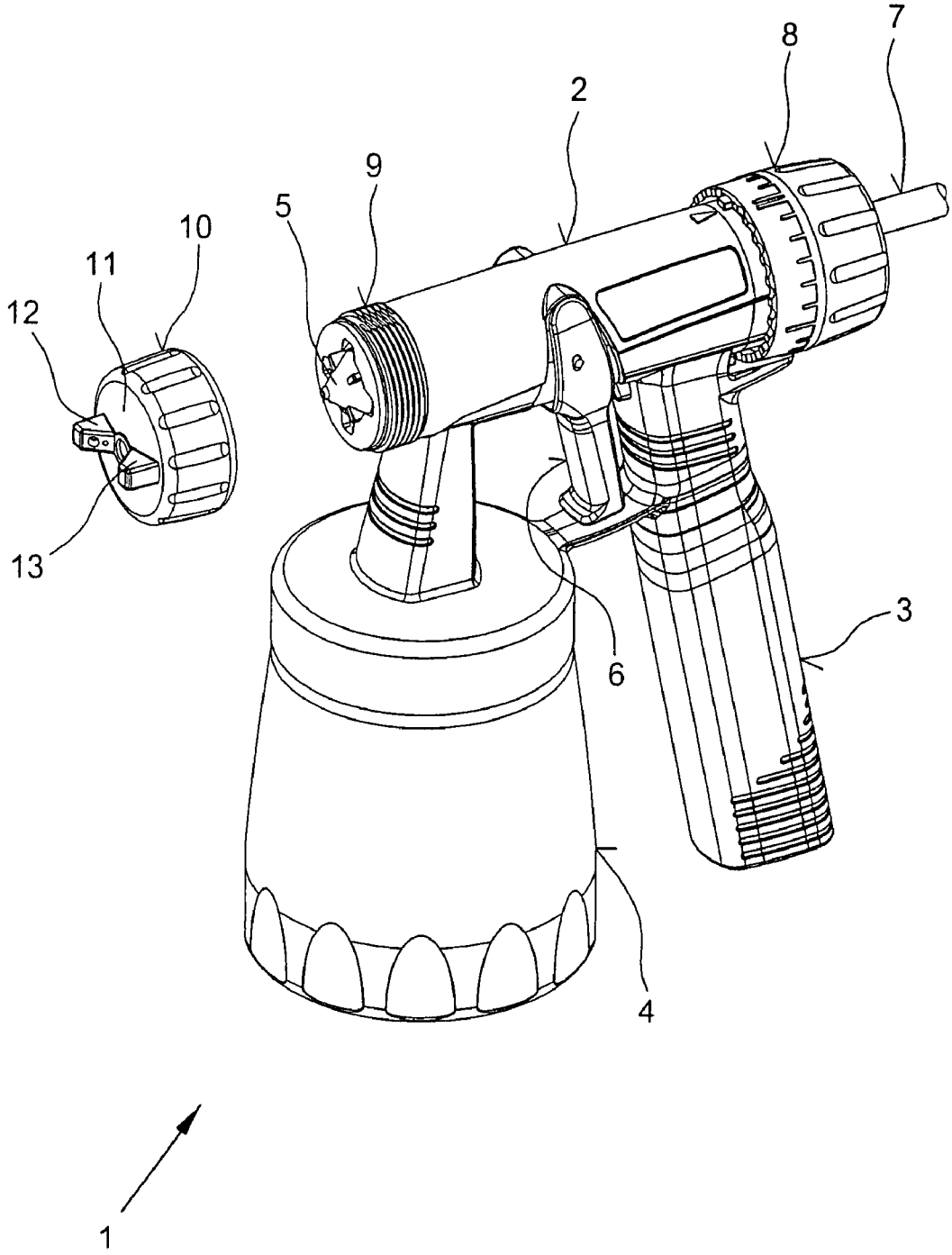
FIG. 1 shows a perspective view of the spray gun with the air cap unscrewed.

The spray gun shown in FIG. 1 and identified with 1 is used for spraying paints or varnishes and principally comprises a gun housing 2 for accommodating the propulsion mechanism, the components that effect mixture and/or metering, a handle 3 projecting from the gun housing 2 and a reservoir tank 4 for holding the medium to be processed. The medium sucked up from the reservoir tank 4 is atomised by compressed air that is supplied via a line 7 of an atomiser nozzle 5 through the housing 2. In the sample embodiment shown, the atomiser nozzle 5 is held by a union nut 10 that can be screwed onto a thread 9 worked into the gun housing 2. A nozzle needle 16 reaching into the atomiser nozzle 5 can be actuated by a handle 6, and additionally the quantity of paint can be controlled using a set screw 8.

Figure 12A:
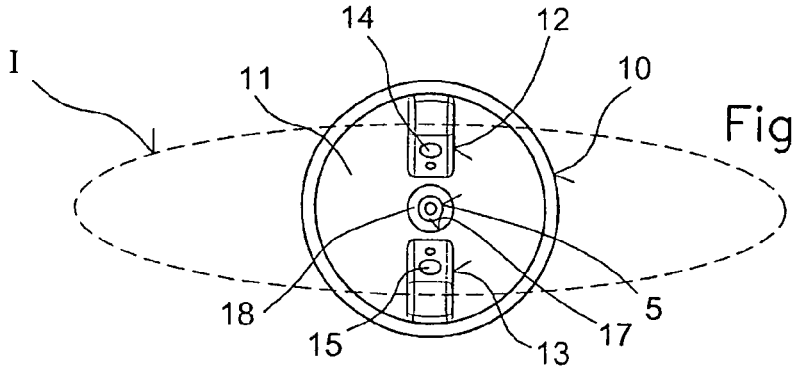
Figure 12B:
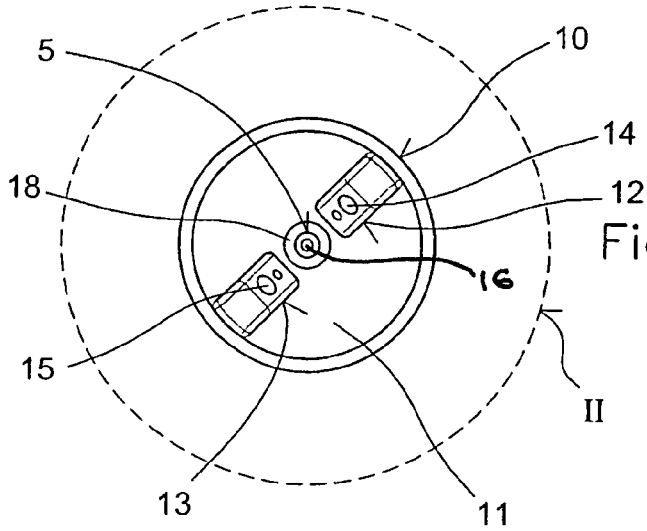
Figure 12C:
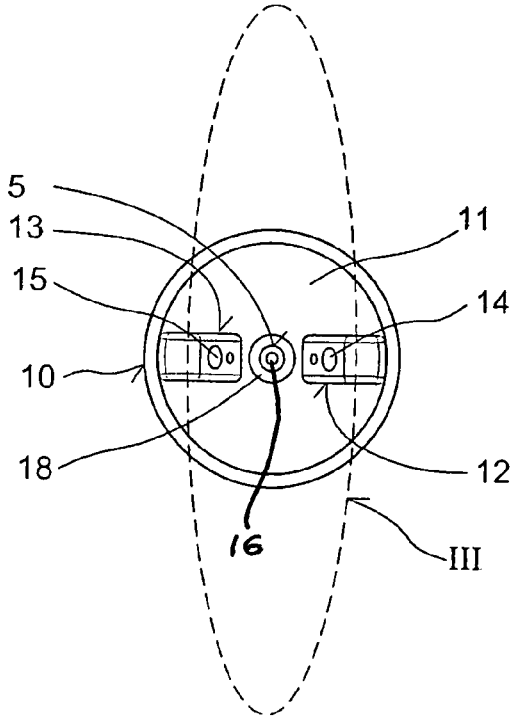

The spray gun 1 is equipped with an air cap 11 by means of which, as is shown in FIGS. 12*a*, 12*b* and 12*c*, it is possible to twist the air cap 11 to create three different spray jets I, II and III, namely a horizontally oriented flat jet I, a round jet II and a vertically oriented flat jet III.

In order to achieve this, the atomiser nozzle 5 is installed in an oriented position in the gun housing 2 and is provided with penetrations 19 for the compressed air, and the air cap 11 possesses two diametrically opposed horns 12 and 13 with air outlet openings 14 or 15 worked into them. The compressed air flowing out of outlet openings 14 and 15 has an effect on the continuous jet of paint ejected from the atomiser nozzle 5 during the operation of the spray gun 1 such that the jet is turned into spray jets I and III. In the position of the atomiser nozzle 5 shown in FIG. 12*b*, the supply of compressed air to the outlet openings 14 and 15 is shut off and compressed air only continues to flow out of a ring duct 18 that is formed by the atomiser nozzle 5 reaching into a hole 17 arranged centrally in the air cap 11.

In order to allow the air cap 11 to be adjusted quickly and easily, it is positively connected with the union nut 10 in a circumferential direction, with the effect that it is only necessary to twist the union nut through 45° or 90° in order to set the spray gun 1 from the position corresponding to spray jet I to the positions for spray jet II or spray jet III. There is no need to grip the air cap 11 in order to do this, therefore there is practically no risk of getting dirty. It is merely necessary to move the union nut 10 screwed onto the gun housing 2 by means of an internal thread 20 through either 45° or 90° into the positions shown in FIG. 12*b* or 12*c*.

Figure 2:
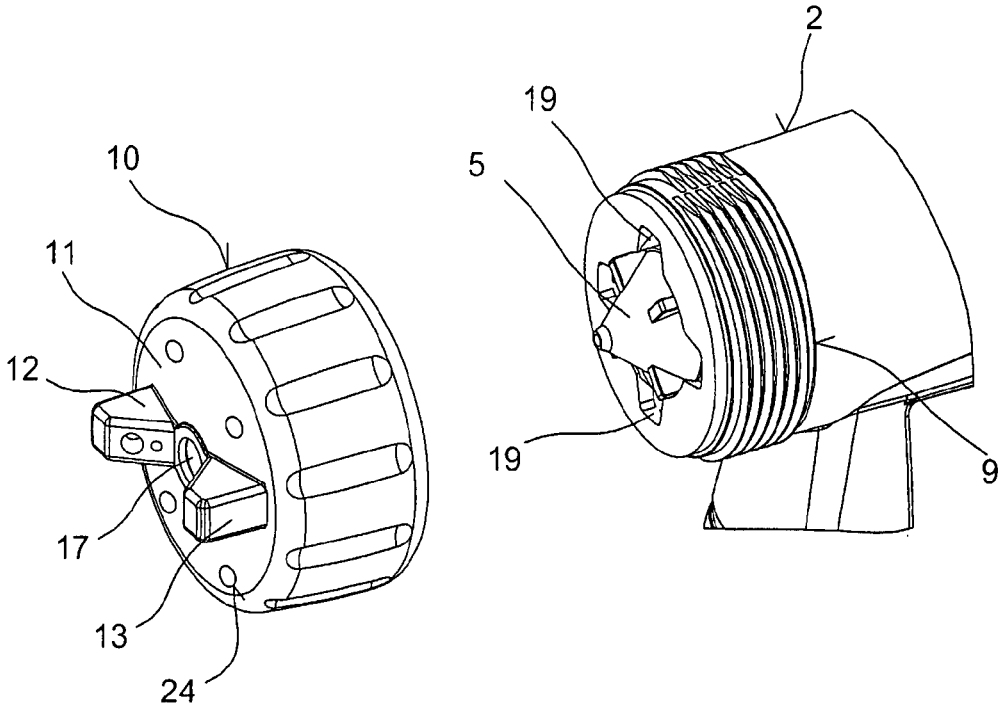
FIG. 2 shows a magnified view of part of the housing of the spray gun in accordance with FIG. 1 with the air cap unscrewed.

The positive connection between the air cap 11 and the union nut 10 in the turning direction can be achieved in different ways. In accordance with FIGS. 1 and 2, the air cap 11 is directly formed into the union nut 10 with the effect that they are configured in one piece and can be manufactured as an injection-moulded component.

Figure 3:
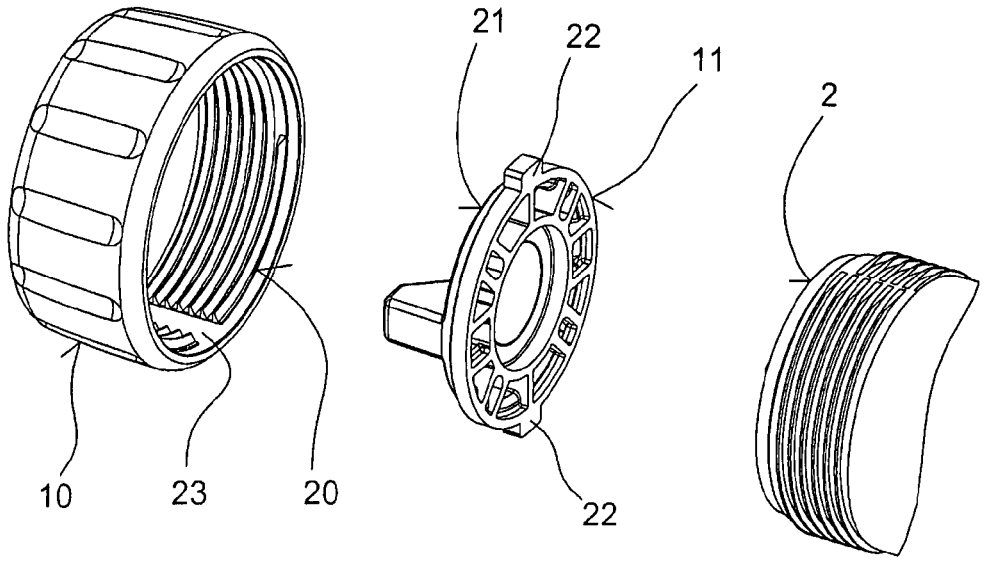

In accordance with FIG. 3, the air cap 11 is provided with a ring 21 firmly connected to it and with radially projecting cams 22 attached to the ring 21. The union nut 10 furthermore possesses lengthways grooves 23 into which the cams 22 engage. The air cap 11 is therefore driven by the union nut 10 when it is turned, and is moved accordingly.

In the embodiments shown in FIGS. 4 to 10, a holding element 31 with an equivalent effect to the union nut 10 is once again positively connected to an air cap 32 in the turning direction and can additionally be locked in the operating positions corresponding spray jets I, II, III. This is achieved in each case by means of a control cam 35, 35', 35" or 35'" into which guide elements 36, 36', 36" or 36'" engage. Also, radially projecting cams 33 serve to connect the air cap 32 to the holding element 31 in a torsionally rigid arrangement and these cams 33 engage in slots 34 worked into the union nut 31.

In the embodiment shown in FIG. 4, two control cams 35 arranged opposite to one another are worked into the gun housing 2 and guidance elements 36 are provided in the form of two pins 37 projecting radially inwards from the holding element 31. In accordance with FIG. 5, however, the guide elements 36' are attached to the gun housing 2 and the control cams 35' are provided in the holding element 31.

Figure 6:
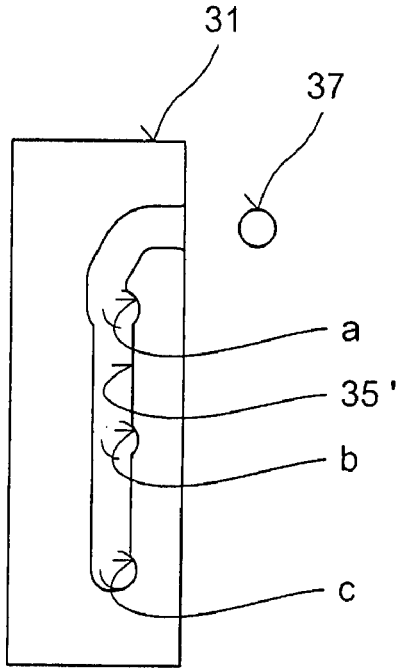
FIG. 6 shows a developed view of the control cams provided in the embodiments in accordance with FIGS. 3 to 5, FIGS. 7 to 9 show further embodiments of the positive connection between the air cap and a holding element, also in defined detent positions and in exploded views.

FIG. 6 shows the manner in which the control cams 35 and 35' in the embodiments in FIGS. 4 and 5 are configured. In this case, the control cams 35 or 35' are open at one end and are equipped with three detent positions a, b and c into which the pins 37 can be engaged in the operating positions corresponding to spray jets I, II and III.

Figure 7:
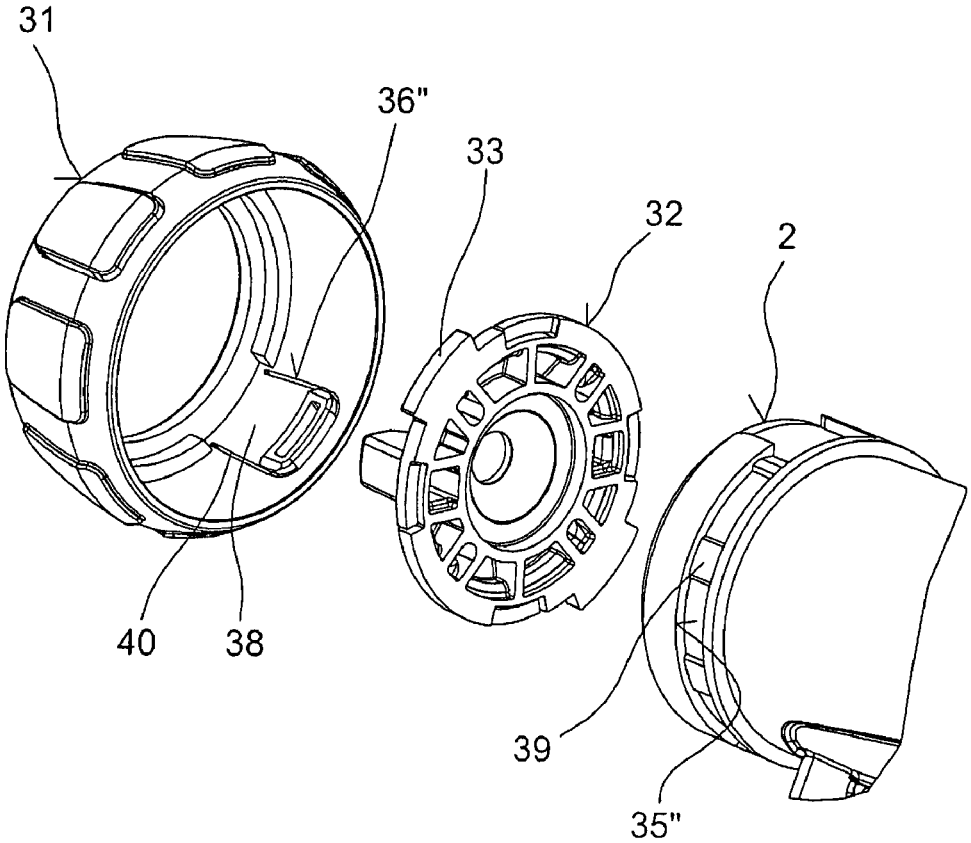
Figure 8:
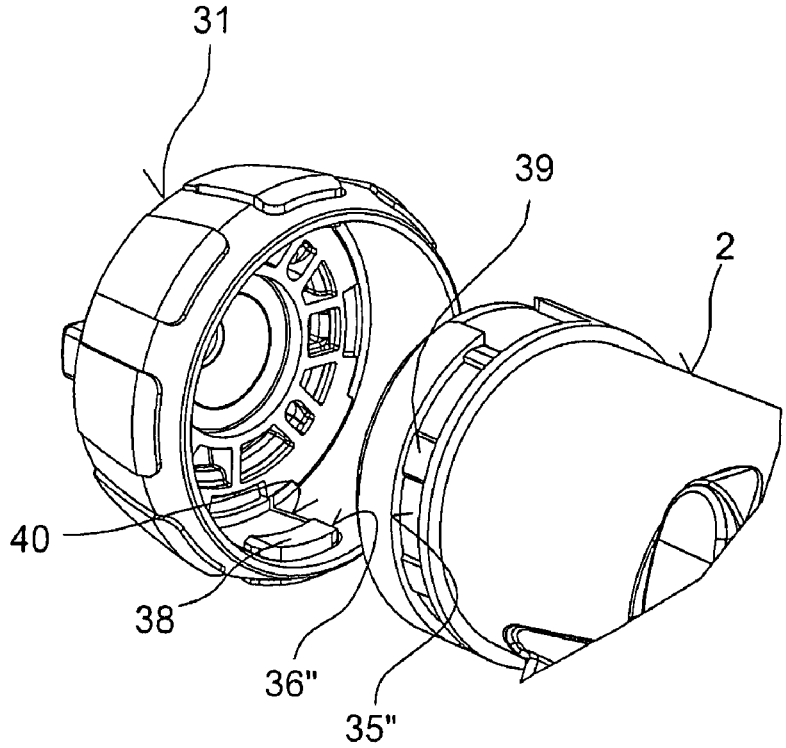
Figure 9:
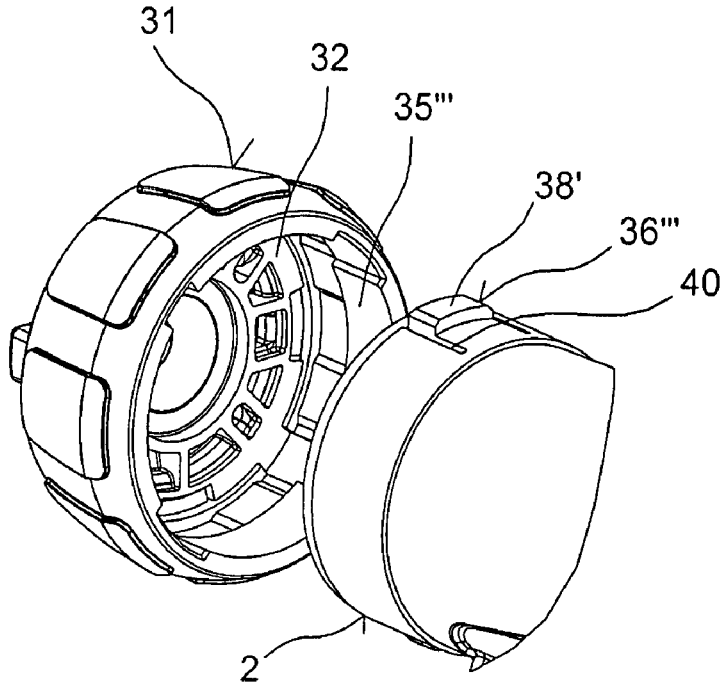
Figure 10:
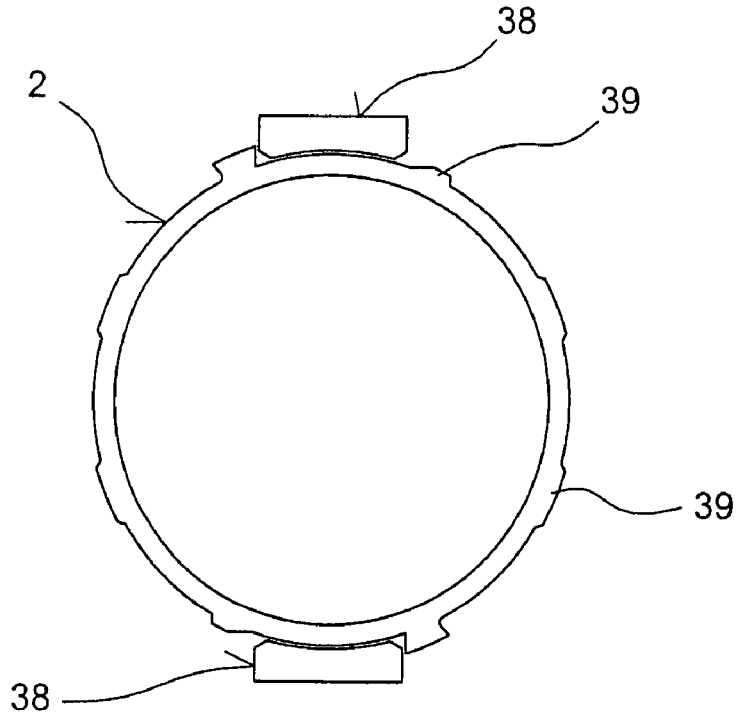
FIG. 10 shows the control cams provided in the embodiments in accordance with FIGS. 7 to 9.

In accordance with FIGS. 7, 8 and 9, each of the guide elements 36" and 36'" is formed by radially sprung tabs 38 or 38' provided with humps, with the tabs being formed by U-shaped slots 40 worked into the holding element 31 or the housing 2 of the spray gun 1. In turn, the control cams 35" and 35'" that are open at one end possess, as is shown in the embodiments in FIG. 10, detent cams 39 in the form of elevations between which the tabs 38 or 38' in the air cap 32 can be locked in the three corresponding operating positions.

In accordance with FIG. 7, the air cap 32 is provided with radially projecting cams 33 that engage in the holding element 31 in the area of the tabs 38. In accordance with FIGS. 8 and 9, however, the air cap 32 is firmly connected to the holding element 31 in that they are made as one piece.

Figure 11:
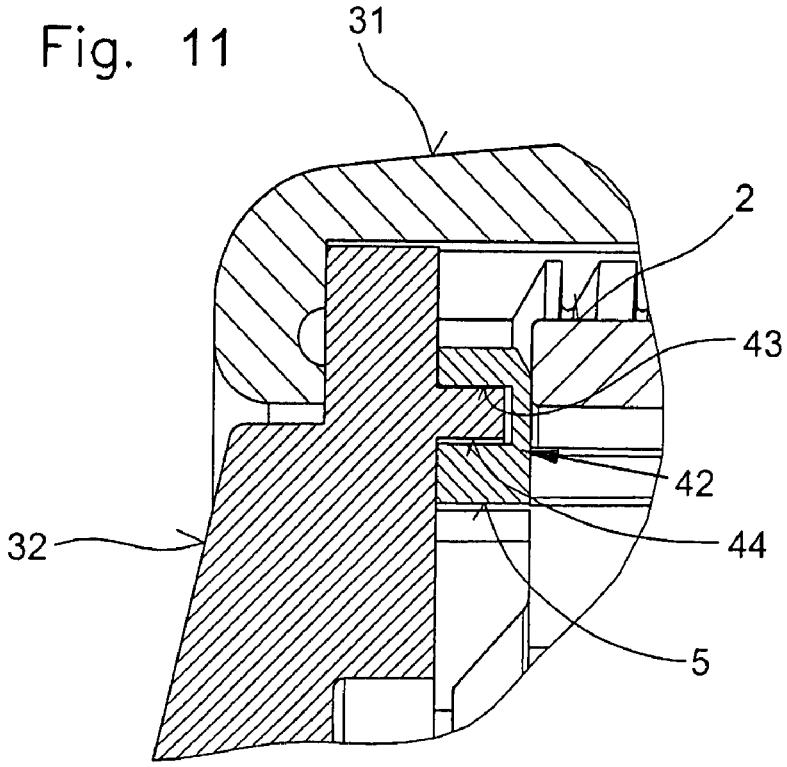
FIG. 11 shows a sectional view of the air cap inserted in the holding element and FIGS. 12*a*, 12*b* and 12*c* show the spray jets created by the spray gun in accordance with FIG. 1 and the corresponding embodiments.

A corrugated spring washer 41 is inserted between the holding element 31 and the air cap 32 in the embodiments shown in FIGS. 4 and 5 so as to guarantee good contact between the air cap 32 and the gun housing 2, or the atomiser nozzle 5, at all times, with the spring washer 41 pressing the air cap 32 against the gun housing 2 or the atomiser nozzle 5. Furthermore, as shown in FIG. 11, a labyrinth seal 42 can be provided between the atomiser nozzle 5 and the air cap 32, with a circumferential web 44 axially projecting from the air cap 32 engaging in a groove 43 worked into the atomiser nozzle 5. This measure prevents the compressed air flowing out radially, whilst in addition the atomiser nozzle 5 is coaxially aligned in this way. Furthermore, in order to counteract a pressure increase in the gun housing 2 when the outlet openings 14 and 15 are closed, several openings 24 can be provided in the air cap 11 or 32 by means of which the compressed air can flow out of the housing 2 into the atmosphere.

It goes without saying that the spray jets I, II and III can be set by turning the union nut 10 or the holding element 31 in all the illustrated embodiments.

The invention claimed is:

1. A spray gun (1) for spraying paints and viscous media that can be propelled pneumatically or electrically, the spray gun comprising:

a housing (2) for accommodating a propulsion mechanism and components that effect mixture and metering;

a handle (3) projecting from said gun housing (2); and a reservoir tank (4) removably attached to said gun housing (2) for holding a medium to be processed;

a union nut (10) placed on said gun housing (2); and an extension pipe and an air cap (11) surrounded by said union nut (10) provided with mutually offset outlet openings (14,15) for compressed air by means of which various spray jets (I, II, III) are formed and with an atomiser nozzle (5) held in an oriented position and opened by means of a nozzle needle (16);

wherein a selected one of said union nut (10) and a holding element (31) is connected with said air cap (11, 32) circumferentially; and wherein the holding element (31) is lockable in angular positions corresponding to the spray jets (I, II, III) and is disposed in an oriented position in relation to said gun housing (2); and wherein a selected one of the gun housing (2), and the holding element (31) is provided with two diametrically opposed control cams (35, 35', 35", 35'") that are open at one end and run in a circumferential direction, and the holding element (31) is provided with guide elements (36, 36', 36", 36'") that engage in the control cams (35, 35', 35", 35'").

2. The spray gun in accordance with claim 1, wherein said air cap (11) is connected to said union nut (10) or holding element (31) by at least one radial cam (22) projecting from an outer jacket surface of said air cap (11) and distributed evenly around the circumference thereof, with the cams (22) engaging in slots (23) in said union nut (10) or holding element (31).

3. The spray gun in accordance with claim 2, wherein said air cap (11) is disposed in a ring (21) and connected to the ring (21), with the cams (22) projecting radially from the ring (21) and engaging in slots in said union nut (10) or the holding element (31).

4. The spray gun in accordance with claim 1, wherein the guide elements (36, 36') comprise guide pins (37) and the control cams (35, 35') comprise recesses (a, b, c) for accommodating said guide pins (37) in the operating positions corresponding to said air cap (32).

5. The spray gun in accordance with claim 1, wherein the guide elements (36", 36'") comprise radially sprung tabs (38) and the control cams (35", 35'") are provided with detent cams (39) distributed in a circumferential direction with even spacing, between which said tabs (38) are lockable in the operating positions corresponding to said air cap (32).

6. The spray gun in accordance with claim 1, wherein said air cap (32) is structurally separate from the holding element (31), and a spring (41) is arranged therebetween, by means of which said air cap (32) can be pressed against a selected one of the atomiser nozzle (5), an intermediate piece, and an extension pipe.

7. The spray gun in accordance with claim 1, wherein said air cap (32) is sealed against said gun housing or other supporting component by a labyrinth seal (42).

8. The spray gun (1)

in accordance with claim 1, wherein the air cap (11, 32) and said union nut (10) and the holding element (31) comprises an injection-moulded unitary component; and wherein the union nut and holding element are turnable by one hand of an operator to provide for a selected formation of spray while the spray gun is in operation.

* * * * *